US005320284A

United States Patent [19]

Nishida et al.

[11] Patent Number: 5,320,284

[45] Date of Patent: Jun. 14, 1994

[54] AGITATING MILL AND METHOD FOR MILLING

[75] Inventors: Masamitsu Nishida, Osaka; Hamae Ando, Neyagawa; Koichi Kugimiya, Toyonaka, all of Japan

[73] Assignee: Matsushita Electric Industrial Co., Ltd., Kadoma, Japan

[21] Appl. No.: 783,678

[22] Filed: Oct. 29, 1991

[30] Foreign Application Priority Data

Oct. 31, 1990 [JP] Japan ..... 2-295722

[51] Int. Cl.[5] ..... B02C 17/16; B02C 17/20

[52] U.S. Cl. ..... 241/21; 241/46.17; 241/184

[58] Field of Search ..... 241/21, 172, 184, 46.17

[56] References Cited

U.S. PATENT DOCUMENTS

| | | | |
|---|---|---|---|
| 3,075,710 | 1/1963 | Feld et al. | 241/16 |
| 3,309,030 | 3/1967 | Molls et al. . | |
| 3,682,399 | 8/1972 | Kaspar et al. | 241/50 |
| 4,225,092 | 9/1980 | Matter et al. | 241/46 B |
| 4,304,362 | 12/1981 | Buhler | 241/67 |
| 4,496,106 | 1/1985 | Gross | 241/46.17 |
| 4,629,133 | 12/1986 | Bühler | 241/46.11 |
| 4,948,056 | 8/1990 | D'Errico | 241/67 |
| 5,011,089 | 4/1991 | Vock et al. | 241/21 |
| 5,065,946 | 11/1991 | Nishida et al. | 241/16 |

FOREIGN PATENT DOCUMENTS

| | | | |
|---|---|---|---|
| 0058886 | 5/1984 | European Pat. Off. . | |
| 3906569 | 9/1990 | Fed. Rep. of Germany | 241/172 |
| 1040798 | 9/1966 | United Kingdom . | |
| 2016953 | 9/1979 | United Kingdom . | |

*Primary Examiner*—Mark Rosenbaum
*Assistant Examiner*—John M. Husar
*Attorney, Agent, or Firm*—Cushman, Darby & Cushman

[57] ABSTRACT

In an agitating mill for producing the objective fine powder, the agitating medium having an average particle diameter of no more than 0.6 mm is charged in an annular gap between the external side wall of the agitator and the internal side wall of the milling vessel. Thereby the agitator can be rotated at a peripheral speed of no less than 30 m/s, and it results in a high grinding rate and reduced amount of impurity which means worn-out grinding media included in the objective fine powder.

8 Claims, 3 Drawing Sheets

AGITATING MILL AND METHOD FOR MILLING

FIELD OF THE INVENTION AND RELATED ART STATEMENT

1. FIELD OF THE INVENTION

The present invention relates to an agitating mill for grinding, mixing, dispersing, homogenizing or the like and method for grinding powder of the material into fine particles. In the present invention, the word "grinding" means not only grinding but also grinding and mixing wherein grinding and mixing are made simultaneously.

2. DESCRIPTION OF THE RELATED ART

In recent years, an agitating mill as a grinder for fine powder has been noticed. In the agitating mill, a cylindrical rotor is disposed concentrically within a cylindrical vessel in a manner that axis of rotation is vertical. The side walls of the rotor and vessel define between them an annular gap or space, within which fed particles are comminuted by forceful interaction with particles of grinding media. The particles to be ground are introduced in fluidized form and forcefully interact with and contact the grinding media to reduce their particle size. That is, the powder (which is particles to be ground) is agitated at high speed with grinding media (elements) (which is called media, beads or round stones) in the agitating mill as a grinding/mixing equipment. The agitating mill is called a sand mill, a beads agitating mill, a sand grinder, an attrition mill etc.

In order to obtain ground fine powder having a particle size of submicron by grinding/mixing in a short time, a packing ratio (which is defined by a ratio of volume of grinding media to a volume of effective grinding zone) has been increased, and/or rotating speed and hence peripheral speed of the cylindrical rotor have been increased in the agitating mill.

But, in case the rotating speed of the cylindrical rotor is increased, remarkable wearing out of the grinding media itself undesirably occurs as a problem. The particle size of worn-out grinding media is as similarly small as that of the objective fine powder. It becomes very difficult to separate the worn-out grinding media from the objective ground fine powder. Thus, it becomes unavoidable that the objective fine powder includes the worn-out grinding media as an impurity. The impurity results in deteriorated characteristic of the fine powder e.g. a broad particle size distribution.

In the conventional agitating mill, for the purpose of prevention of wearing-out of the grinding media, the maximum peripheral speed of the cylindrical rotor must be in the range of 10 m/s–20 m/s. In such range of the peripheral speed it takes a long time to grind.

OBJECT AND SUMMARY OF THE INVENTION

The present invention is intended to solve the above-mentioned problem shown in the related arts. The purpose of the present invention is to provide an agitating mill and method for milling which enable grinding in a short time by high peripheral speed of the cylindrical rotor, wherein the amount of impurity resulting from wearing-out of the grinding media included in an objective fine powder is satisfactory reduced.

These objects are accomplished by an agitating mill comprising:

a milling vessel having an internal side wall, an agitator having an external side wall, the agitator being inserted in the milling vessel coaxially whereby a gap is formed between the internal side wall and the external side wall as a grinding compartment, driving means connected to the agitator for rotating it, and grinding media having an average particle diameter (D(mm)) in the range of between 20 times as large as an average particle diameter of material powder and 0.6 mm the grinding media being charged in the grinding compartment.

By using the agitating mill of the present invention, a high grinding rate is obtained, so that fine powder in the range of between a several $\mu$m and $10_{-2}$ $\mu$m is obtained in a very short time. The amount of impurity which means worn-out grinding media included in the fine powder is remarkably reduced. Further, the very fine powder in the range of nano-meter unit can be produced in large quantity in a very short time.

Grinding ability of the agitating mill of the present invention is remarkably enlarged in comparison with the conventional one which has a milling vessel having the same volume as that of the agitating mill of the present invention.

While the novel features of the invention are set forth particularly in the appended claims, the invention, both as to organization and content, will be better understood and appreciated, along with other objects and features thereof, from the following detailed description taken in conjunction with the drawings.

Figure 1:
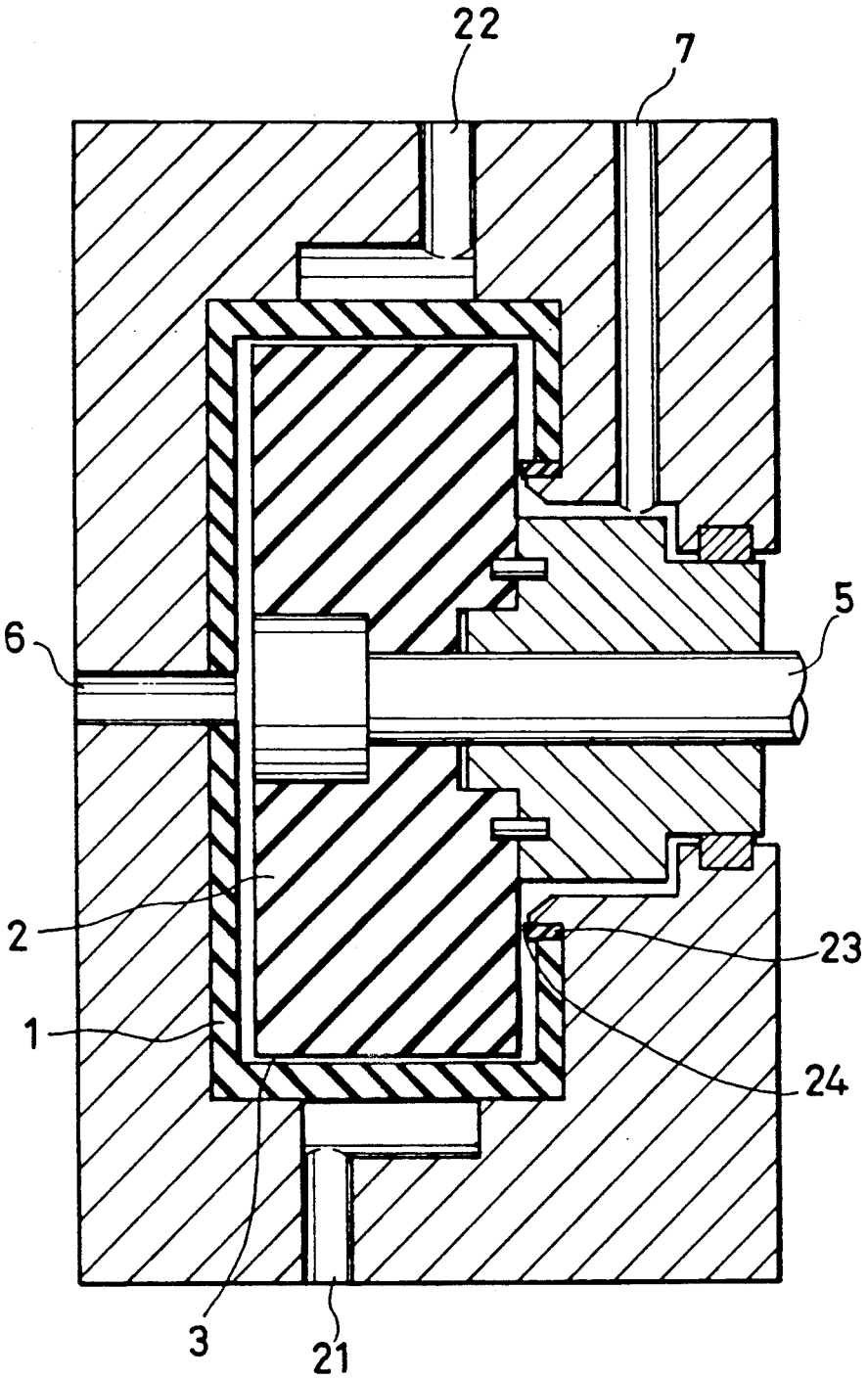
FIG. 1 is a cross-sectional view of a first embodiment of an agitating mill of the present invention.

It will be recognized that some or all of the Figures are schematic representations for purposes of illustration and do not necessarily depict the actual relative sizes or locations of the elements shown.

DESCRIPTION OF THE PREFERRED EMBODIMENTS

Hereafter, preferred embodiments of the present invention are explained with reference to the accompanying drawings.

The agitating mill has a milling vessel 1 having a cylinderlike shaped internal side wall. An agitator 2 has a rotating shaft 5 and an external side wall shaped like a cylinder, and is provided pivotally in the milling vessel 1 coaxially, whereby a narrow annular gap 3 is disposed between the internal side wall of the milling vessel 1 and the external one of the agitator 2. The narrow annular gap 3 serves as a grinding compartment.

The narrow annular gap 3 as the grinding compartment is charged with grinding media. A slurry including particles of material to be ground is introduced into an inlet port 6 by known peristaltic type pump (which is not shown in FIGS.). The particles are ground by interactions with particles of the grinding media within the grinding compartment 3 via rotation of the agitator 2 which is rotated by a known motor (which is not shown in FIGS.) through the rotating shaft 5. After grinding, the slurry is flown through a gap 24 between the agitator 2 and an annular separator 23 which is made of tungsten carbide. The distance of gap 24 is adjusted in a manner that, except the grinding media included in the slurry, only the ground particles (material) can be flown through the gap 24. In the actual case the gap 24 is adjusted at the value from about one third to about a half of the average particle diameter of the grinding media. Owing to the pressure applied to the slurry by the pump, the slurry including the ground particles is discharged from an outlet port 7 mounted in the milling vessel 1.

The outside wall of the milling vessel 1 is water cooled in a manner that water Introduced from a water inlet port 21 absorbs heat released from the outside wall of the milling vessel 1 and is discharged from a water outlet port 22 by a known water pump (not shown in FIGS.).

A period of grinding is shortened by a high grinding rate (speed) of the agitating mill. It seems that the grinding rate is in direct proportion to a number of collisions between the particles to be ground and the grinding media. Thus, the grinding rate increases in direct proportion to $V/D^3$ (wherein, V is a peripheral speed of the agitator, and D is an average particle diameter of the grinding media). Thereby, it is expected that the larger V is and/or the smaller D is, the higher the grinding rate becomes.

As mentioned above, small value of D results in a high grinding rate. When the value of D is above 0.6 mm, amount of wearing-out of tile grinding media becomes remarkably large. Therefore, it is preferable to use the grinding media having the value of D below 0.6 mm. When the value of D is too small, it results in a low grinding rate. From our experiments, we found that it was preferable to use the grinding media having the value of D more than 20 times as large as an average particle diameter of material powder in order to obtain sufficient grinding rate. When the value of V is no less than 30 m/s, remarkably increased grinding rate is obtained.

Main content of the grinding media used in the agitating mill of the present invention can be chosen from the following materials according to the material to be ground: alumina, zirconia, titania, silicon carbide or silicon nitride.

The preferable shape of the grinding media is a substantially spherical one.

Further, when the average particle diameter of the grinding media is selected in the range of from 20 times to 2000 times of the average particle diameter of the particles (of the material) to be ground before grinding, it becomes efficient to grind the particles to be ground. That is, by using such grinding media, optimum short time to grind the particles is attained.

When the value of D (mm) and the value of V (m/s) satisfy the following inequality (1):

$$D^3 \times V^2 \leqq 200 \quad (1),$$

amount of undesirably worn out grinding media can be reduced. Since the amount of wearing-out per unit time is in direct proportion to the production of a kinetic energy of a particle of grinding media and number of collisions, the amount of wearing-out is in direct proportion to $V^3$. Therefore, the grinding rate is in direct proportion to $V/D^3$ as mentioned afore. Thereby, a ratio of the amount of wearing-out to the grinding rate is in direct proportion to $[D^3 \times V^2]$. The smaller the value of $[D^3 \times V^2]$ is, the shorter the time wherefore the objective fine powder which includes the more reduced amount of the worn-out grinding media as impurity is obtained.

From our experiments, it is found preferable to select the value of $[D^3 \times V^2]$ in the range of no longer than 200. In case the value of $[D^3 \times V^2]$ is above 200, the wearing-out of the grinding media becomes large and it results in a large amount of tile impurity in some cases.

Further, it is more preferable to make the gap 3 in the range of no more than 5 mm, so that a ratio of a surface area of the internal side wall of the milling vessel 1 to an effective volume of the milling vessel 1 is enlarged. Thereby, generation of heat due to grinding of the slurry can be released effectively, and the peripheral speed of the agitator 2 can be enlarged.

Further, in case the narrow annular gap 3 is less than 2 mm, it enables a remarkable high peripheral speed of the agitator 2 and results in the high grinding rate, since the above-mentioned heat can be released more effectively. In contrast, in case the narrow annular gap 3 is less than several times the value of D, sufficient interaction between the particles to be ground and the particles of the grinding media is not obtained, and it results in a low grinding rate. Thus it is preferable to make the gap 3 no less than several times as large as the value of D.

It is preferable that the slurry is prepared to have a specific gravity in a range of from 0.5 times to 1 time of that of the grinding media, since an impulsive force among the grinding media is reduced in this range, and it results in reduction and wearing-out of the grinding media. That is, grinding of the material (to be ground) is carried out by frictional force rather than the impulsive force, and it results in prevention of contamination of the slurry owing to the impurity.

The slurry is prepared mainly by mixing of the powdered material to be ground and dispersing medium. In case usual powdered material such as $Pb_3O_4$ or $TiO_2$ and usual dispersing medium such as water or ethanol are used, it is preferable that the ratio of a volume of the dispersing media to a real volume of the powdered material is less than four. Selecting the above-mentioned ratio, is done since the period of grinding is shorted and contamination of the slurry owing to the impurity is prevented. The real volume is defined by a ratio of the weight of the powdered material to the specific gravity of the same material in solid form. That is, undesirable wearing-out of the grinding media is prevented. Water, ethanol, trichloroethane and the like are used as the dispersing media.

When powdered material is ground and dispersed by using the grinding media, it is preferable to mix a usual dispersing agent (e.g. a poly carboxylic type dispersing agent) placed on the market and the like, since the dispersing agent prevents the ground fine powder from undesirable cohesion. It is necessary to select a suitable kind of dispersing agent with a suitable amount corresponding to kind of the powder, average particle diameter of the same, kind of the dispersing media and the like.

The agitating mill of the present invention can be used whether the axis of the agitator is vertical or horizontal. The material to be ground can be fed into the agitating mill continuously or intermittently.

Figure 2:
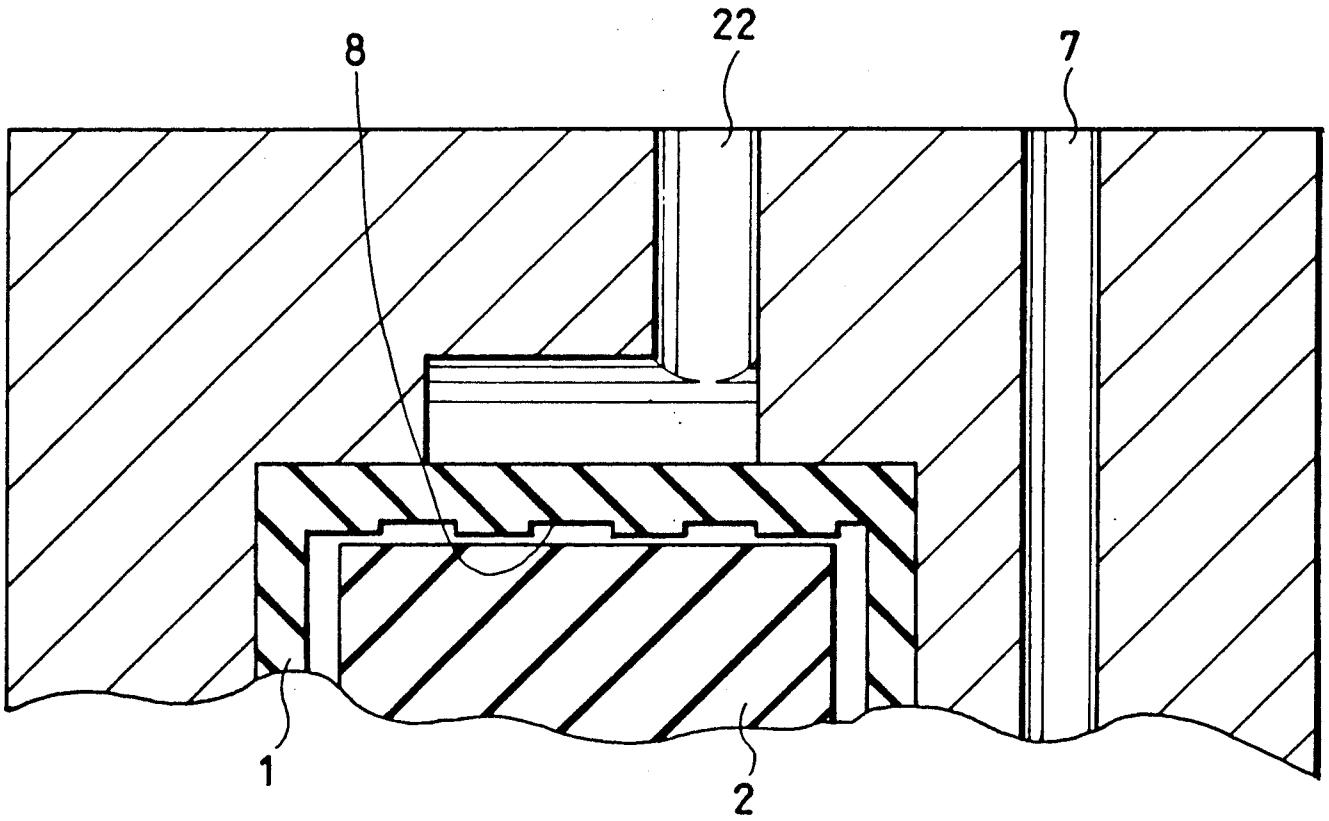
FIG. 2 is an enlarged cross-sectional view of the internal side wall of the milling vessel 1' of the second embodiment of the agitating mill of the present invention.

A second embodiment of the agitating mill of the present invention is similar to the first embodiment except that a surface of an internal side wall of a milling vessel 1 is changed. FIG. 2 is an enlarged cross-sectional view showing the internal side wall of the milling vessel 1 of the second embodiment of the agitating mill of the present invention. Corresponding parts and components to the first embodiment are shown by the same numerals and marks, and the description thereon made in the first embodiment similarly apply. Differences and features of this second embodiment from the first embodiment are as follows. As shown in FIG.2, the surface of the internal side wall of the milling vessel 1 is finished unevenly. That is, an uneven surface 8 is formed. Complicated motion of the grinding media during grinding is made owing to unevenness of the surface 8. It results in large friction (resistance) with the grinding media, so that larger grinding rate is obtained.

In FIG. 2, the uneven surface 8 is formed on the internal side wall of the milling vessel 1, and similar uneven surface may be formed on the external side wall of the agitator. In this case, the uneven surface can be formed only on the external side wall of the agitator or the uneven surfaces can be formed on both the internal side wall of the milling vessel and the external one of the agitator.

The uneven surface 8 as shown in FIG. 2 is formed in a manner that numerous grooves having a sectional shape of trapezium, rectangle or the like are made in the direction of circumference. These grooves can be made similarly in the direction parallel to axis of the cylindrical milling vessel as in an internal gear. Further, numerous recesses can be formed instead of the grooves.

Figure 3:
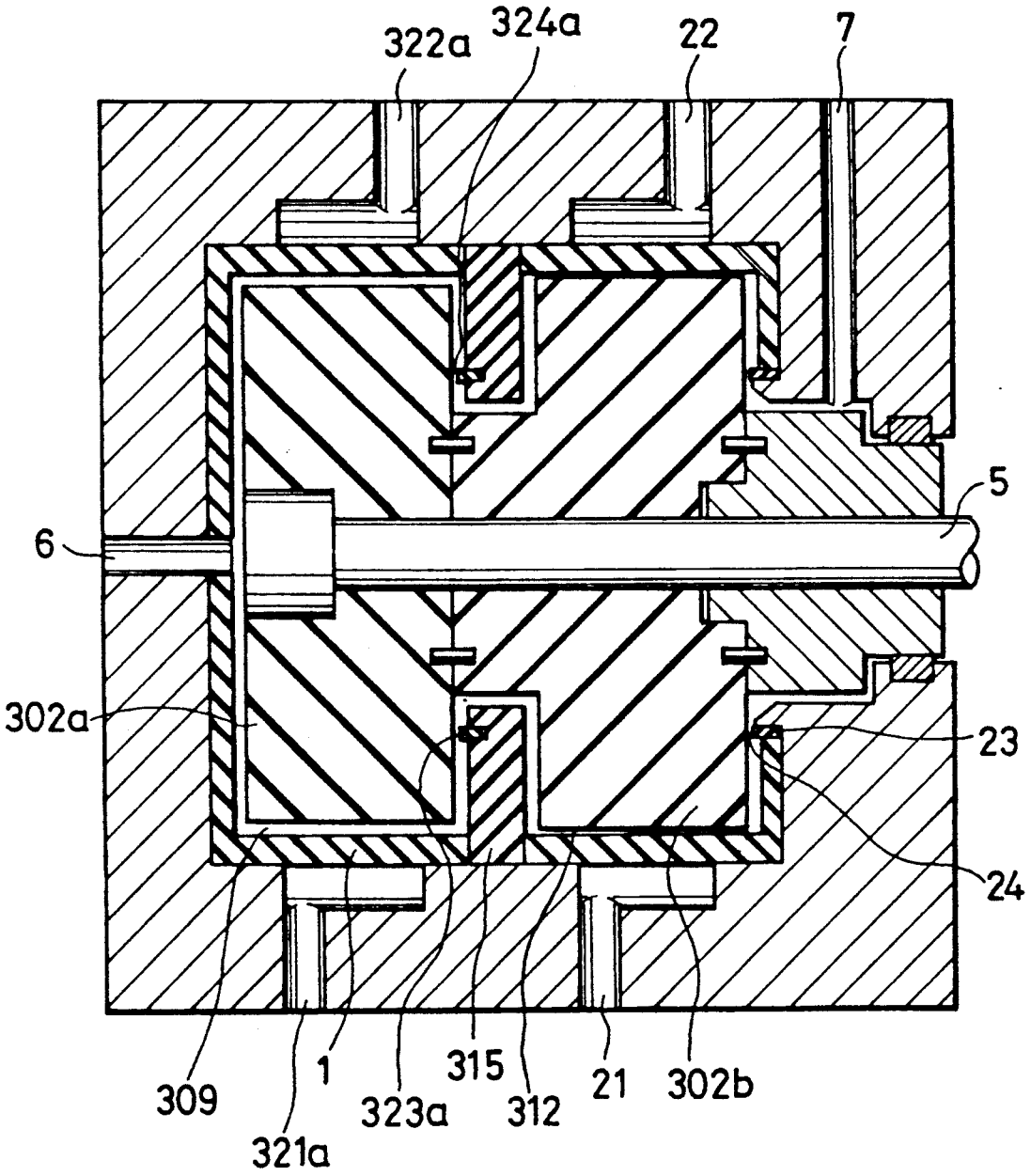
FIG. 3 is a cross-sectional view of a third embodiment of an agitating mill of the present invention.

FIG. 3 is a cross-sectional view of a third embodiment of an agitating mill of the present invention. Corresponding parts and components to the first embodiment are shown by the same numerals and marks, and the description thereon made in the first embodiment similarly apply. Differences and features of this third embodiment from the first embodiment are as follows. The agitating mill has two grinding compartments 309 and 312. The milling vessel 301 has an annular partition wall 315 in a manner that a grinding compartment in the milling vessel 1 is divided into the first grinding compartment 309 and second one 312. Two agitators **302*a* and 302*b* are combined coaxially on a rotating shaft 5. Both the agitators 302*a* and 302*b* are rotated by a known motor (which is not shown in FIGS.) through the rotating shaft 5. The first grinding compartment 309 is charged with a first grinding media having a relatively large average particle diameter, and the second grinding compartment 312** is charged with a second grinding media having a relatively small average particle diameter.

At first, the slurry is introduced in the first grinding compartment 309 through an inlet port 6. The slurry ground in the first ground compartment 309 is then automatically introduced in the second grinding compartment 312 through a gap **324*a* between the first agitator 302*a* and an annular separator 323*a*. The gap 324*a* is adjusted similarly to the gap 24 shown in FIG. 1. Thus, only the ground particles (material) can be flown through the gap 324*a* into the second grinding compartment 312. Since the average particle diameter of the second grinding media in the second grinding compartment 312 is selected relatively smaller than that of the first one in the first grinding compartment 309, respective grindings are carried out by respective grinding media having suitable average particle diameter for the particles to be ground in respective grinding compartment. Thereby, it results in effective grinding. In the actual case it is preferable that an average particle diameter of the second grinding media is about from one tenth to one third of that of the first one. The slurry is discharged from the outlet port 7 through the gap 24 which is as same size as the gap 24 shown in FIG. 1**.

In at least one grinding compartment, for instance, desirably in the second grinding compartment 312, it is preferable that a peripheral speed $V_2$ of the agitator **302*b*** is no less than 30 m/s and the average particle diameter $D_2$ of the second grinding media is no more than 0.6 mm. Further, when the value of $[D_2^3 \times V_2^2]$ is no more than 200, more effective grinding is obtained.

In the agitating mill of the present invention, since undesirable wearing-out of the grinding media is reduced extremely, it becomes possible to increase revolutions of the agitator without any restriction. That is, velocity of moving particles of the grinding media can be increased freely, and undesirable wearing-out of the grinding media due to the impulsive force is reduced drastically as a result of small particle size of the grinding media.

Hereafter, concrete examples of the present invention are elucidated.

EXAMPLE 1

An agitating mill as-shown in FIG. 1 was used in this Example 1. The following is a list of representative dimension of the agitating mill of this Example 1.

TABLE 1

| | Representative dimensions of the agitating mill |
|---|---|
| (1) The inner diameter of the milling vessel 1 | 60 mm |
| (2) The length of the milling vessel 1 | 32 mm |
| (3) The outside diameter of the agitator 2 | 56 mm |
| (4) The length of the agitator 2 | 30 mm |

Both the milling vessel and the agitator 2 were made of zirconia.

The grinding compartment 3 was charged with powder of zirconia having an average particle diameter of 0.1 mm as the grinding media at a packing ratio of 75%.

Using powder of material of $Pb_3O_4$, ZnO, $SnO_2$, $Nb_2O_5$, $TiO_2$ and $ZrO_2$ having an average particle diameter of 2.3 μm, the slurry to be ground was prepared as follows: The powder was weighed to make a composition represented by $Pb\,(Zn_{\frac{1}{3}}\,Nb_{\frac{2}{3}})_{0.09}\,(Sn_{\frac{1}{3}}\,Nb_{\frac{2}{3}})_{0.09}\,Ti_{0.42}\,Zr_{0.40}\,O_3$. The powder including these 6 kinds of ceramic was preliminarily mixed in a mixer with pure water of 1.7 times as large as true volume of the whole powder and a poly carboxylic type dispersing agent (e.g. "SERAMO D134" manufactured by DAI-ICHI KOGYO SEIYAKU CO., LTD. in Japan) of 0.3 times as large as true volume of the same. Grinding was carried out at 100 m/s of the peripheral speed of the agitator 2.

It took 0.2 minutes to obtain an objective slurry including ground powder having an average particle diameter of 0.1 μm. The amount of the worn-out grinding media included in the objective ground powder was only 0.012 weight % of the powder component in the whole slurry. (Hereinafter the amount of the worn-out grinding media is defined as mentioned above.)

In the above-mentioned constitution, when the gap 3 between the internal side wall of the milling vessel 1 and external one of the agitator 2 was adjusted longer than 5 mm, it became difficult to cool the slurry in grinding. This is because the ratio of a surface area of the internal side wall of the milling vessel 1 to an effective volume (which is a volume of the grinding media and the slurry contained in the grinding compartment 9) of the milling vessel 1 was reduced. When the gap 3 was longer than 7 mm, the temperature of the slurry in grinding easily rose to more than 80° C. Therefore, it was necessary to rotate the agitator 2 intermittently during milling.

The uneven surface was formed on the only part of internal sidewall of the milling vessel 1 which faces the agitator. The uneven surface was formed in a manner that a number of grooves having depth of 1 mm were made in the direction of the axis of the milling vessel 1, with separation distance of 31.4 mm therebetween. Thus, the milling vessel 1 looks like an internal gear. When the uneven surface was formed, it took only 0.1 minutes to obtain the objective slurry including ground powder of average particle diameter of 0.1 μm. The amount of the worn-out grinding media included in the powder was reduced to 0.003 weight % owing to such a short grinding period.

EXAMPLE 2

Some experiments were carried out in this Example 2 in order to show influence of the average particle diameter of the grinding media upon the grinding characteristic of the powder.

In this Example 2, the agitating mill used in the Example 1 was used under a condition similar to that of the Example 1. Differences and features of this Example 2 from the Example 1 are as follows.

The period of grinding for obtaining the objective powder having the average particle diameter of 0.1 μm and the amount of the worn-out grinding media included in the objective powder were measured by varying the average particle diameter D of the grinding media. And the peripheral speed V of the agitator 2 was kept constant at 40 m/s in each working sample. The obtained results were shown in Table 2.

TABLE 2

| Working sample No. | Average particle diameter D of the grinding media (mm) | Peripheral speed V of the agitator (m/s) | Period of grinding (min) | Amount of the worn-out grinding media (wt %) |
|---|---|---|---|---|
| 1 | 0.1 | 40 | 1.3 | 0.006 |
| 2 | 0.5 | 40 | 18 | 0.241 |
| *3 | 0.8 | 40 | 159 | 2.89 |

*This working sample No. 3 is a comparison working sample.

From Table 2, in case the average particle diameter of the grinding media was above 0.6 mm, it is clear that it took an extremely long period of grinding and that the amount of the worn-out grinding media included in the objective powder was increased.

EXAMPLE 3

Some experiments were carried out in this Example 3 in order to show influence of the peripheral speed V of the agitator upon the grinding characteristic of the powder.

In this Example 3, the agitating mill used in the Example 1 was used under a condition similar to that of the Example 1. Differences and features of this Example 3 from the Example 1 are as follows.

The period of grinding for obtaining the objective powder having average particle diameter of 0.1 μm and the amount of the worn-out grinding media included in the objective powder were measured by varying the peripheral speed V of the agitator. The average particle diameter D of the grinding media was kept at 0.3 mm in each working sample. The obtained results were shown in Table 3.

TABLE 3

| Working sample No. | Average particle diameter D of the grinding media (mm) | Peripheral speed V of the agitator (m/s) | Period of grinding (min) | Amount of the worn-out grinding media (wt %) |
|---|---|---|---|---|
| *4 | 0.3 | 20 | 11.8 | 0.023 |
| 5 | 0.3 | 30 | 5.8 | 0.031 |
| 6 | 0.3 | 80 | 1.9 | 0.136 |

*This working sample No. 4 is a comparison working sample.

From Table 3, it is found that the faster the peripheral speed V of the agitator became the shorter time it took to grind. When the peripheral speed V was not less than 30 m/s, it took rather short time to grind.

EXAMPLE 4

Some experiments were carried out in this Example 4 in order to show influence of the value of $[D^3 \times V^2]$ upon the grinding characteristic of the powder.

In this Example 4, the agitating mill used in the Example 1 was used under a condition similar to that of the Example 1. Differences and features of this Example 4 from the Example 1 are as follows.

The period of grinding for obtaining the objective powder having average particle diameter of 0.1 μm and the amount of the worn-out grinding media were measured by varying the value of $[D^3 \times V^2]$. In order to vary the value of $[D^3 \times V^2]$, both D and V were changed in each working sample. The obtained results were shown in Table 4.

TABLE 4

| Working sample No. | Average particle diameter D of the grinding media (mm) | Peripheral speed V of the agitator (m/s) | Value of $D^3 \times V^2$ | Period of grinding (min) | Amount of the worn-out grinding media (wt %) |
|---|---|---|---|---|---|
| 7 | 0.1 | 100 | 10 | 0.2 | 0.012 |
| 8 | 0.2 | 100 | 80 | 1.1 | 0.099 |
| 9 | 0.6 | 30 | 194 | 49.4 | 0.251 |
| *10 | 0.6 | 50 | 540 | 31.5 | 0.838 |

*This working sample No. 10 is a comparison working sample.

From Table 4, it was found that the smaller the value of $[D^3 \times V^2]$ was, the smaller the amount of the worn-out grinding media became. When the value of $[D^3 \times V^2]$ was over 200, the amount of the worn-out grinding media was increased remarkably. Thus, it is preferable to keep the value of $[D^3 \times V^2]$ not more than 200.

EXAMPLE 5

Some experiments were carried out in this Example 5 in order to show influence of a ratio (D/d) of the average particle diameter "D" of the grinding media to an average particle diameter "d" of the particles (of powder) to be ground.

In this Example 5, the agitating mill used in the Example 1 was used under a condition similar to that of the Example 1. Differences and features of this Example 5 from the Example 1 are as follows.

In the first step, relatively coarse powder to be ground was prepared as follows. The powder of material as same as that used in the Example 1 was mixed and preliminarily heated at 1000° C., and was coarsely ground to obtain the relatively coarse powder having an average particle diameter of 9.5 μm.

In the second step, relatively fine powder to be ground was prepared as follows. The above-mentioned relatively coarse powder was further ground by a ball mill to obtain relatively fine powder to be ground having an average particle diameter of 0.2 μm.

The period of grinding for obtaining the objective powder having the average particle diameter of 0.1 μm and the amount of the worn-out grinding media were measured by varying the ratio (D/d), using both the above-mentioned powders to be ground and powder of zirconia having an average diameter of 100 μm, 200 μm, 400 μm or 500 μm as the grinding media. The peripheral speed V of the agitator 2 was kept constant at 100 m/s in each working sample. The obtained results were shown in Table 5.

TABLE 5

| Working sample No. | Average particle diameter D of the grinding media (μm) | Peri-pheral speed V of the agitator (μm) | Value of the ratio (D/d) | Period of grinding (min) | Amount of the worn-out grinding media (wt %) |
|---|---|---|---|---|---|
| 11 | 100 | 9.5 | 10.5 | 2.3 | 0.256 |
| 12 | 200 | 9.5 | 21.1 | 2.7 | 0.045 |
| 13 | 100 | 0.2 | 500 | 1.1 | 0.031 |
| 14 | 400 | 0.2 | 2000 | 18.3 | 0.157 |
| 15 | 500 | 0.2 | 2500 | 35.6 | 0.420 |

From Table 5, it is found that in case the value of the ratio (D/d) was in the range of from 20 to 2000, small amount of the worn-out grinding media was obtained. The ratio (D/d) was out of the range, the amount of the worn-out grinding media became large.

EXAMPLE 6

Some experiments were carried out in this Example 6 in order to show influence of a ratio of a specific gravity $L_S$ of the slurry to be ground to a specific gravity $L_M$ of the grinding media upon the grinding characteristic of the powder.

In this Example 6, the agitating mill used in the Example 1 was used under a condition similar to that of the Example 1. Differences and features of this Example 6 from the Example 1 are as follows.

The specific gravity $L_S$ of the slurry was adjusted by changing a composition of powder of material, a dispersing agent and the dispersing media (i.e. pure water). For example, the slurry having a high concentration and a high specific gravity was obtained by high dispersion due to addition of a dispersing agent via a conventional method.

The specific gravity $L_M$ of the grinding media was varied by changing the material of the grinding media. When powder of titania having an average particle diameter of 0.4 mm was used as the grinding media, the specific gravity $L_M$ became 3.9. When powder of zirconia having an average particle diameter of 0.4 mm was used as the grinding media, the specific gravity $L_M$ became 6.0.

The period of grinding for obtaining the objective powder having average particle diameter of 0.1 μm and the amount of the worn-out grinding media included in the objective powder were measured. And the peripheral speed V of the agitator 2 was kept constant at 40 m/s in each working sample. The obtained results were shown in Table 6.

TABLE 6

| Working sample No. | Specific gravity $L_M$ of the grinding media | Specific gravity $L_S$ of the slurry | Ratio $L_S/L_M$ | Period of grinding (min) | Amount of the worn-out grinding media (wt %) |
|---|---|---|---|---|---|
| 16 | 3.9 | 1.6 | 0.41 | 29.0 | 2.15 |
| 17 | 3.9 | 2.1 | 0.54 | 17.2 | 0.809 |
| 18 | 3.9 | 3.2 | 0.82 | 14.8 | 0.651 |
| 19 | 6.0 | 2.1 | 0.35 | 18.7 | 0.528 |
| 20 | 6.0 | 3.1 | 0.52 | 15.2 | 0.156 |

From Table 6, it is found that when the ratio $L_S/L_M$ was more than 0.5, the amount of the worn-out grinding media was reduced. The reason of reduction is as follows. An impulsive force of the grinding media is reduced by reduction of the gravity $L_S$, so that grinding due to frictional force is carried out mainly. And it results in reduced amount of the worn-out grinding media. Further, it results in short period of grinding. In contrast, when the ratio $L_S/L_M$ was less than 0.5, large amount of the worn-out grinding media was produced.

EXAMPLE 7

Some experiments were carried out in this Example 7 in order to show influence of the volume of the dispersing media upon the grinding characteristic of the powder.

In this Example 7, the agitating mill used in the Example 1 was used under a condition similar to that of the Example 1. Differences and features of this Example 7 from the Example 1 are as follows.

The volume of the dispersing media (i.e. pure water in this Example 7) was changed in each working sample. It is necessary to estimate the volume of the dispersing media in relation with the volume of the powder to be ground. Thus, a volume ratio of the dispersing media is defined as a ratio of the volume of the pure water to the volume of the powder to be ground.

The period of grinding for obtaining the objective powder having the average particle diameter of 0.1 μm and the amount of the worn,out grinding media were measured by varying the volume ratio of the dispersing media. The volume ratio of the dispersing media was adjusted by changing respective volumes of the powder, pure water and/or dispersing agent. The obtained results were shown in Table 7.

TABLE 7

| Working sample No. | Volume ratio of the dispersing media | Period of grinding (min) | Amount of the worn-out grinding media (wt %) |
|---|---|---|---|
| 21 | 1.7 | 0.2 | 0.012 |
| 22 | 4.0 | 0.6 | 0.051 |
| 23 | 6.0 | 1.0 | 0.253 |

From Table 7, it is found that when the volume of the dispersing media was smaller than 4 times as large as the true volume of the powder and the dispersing agent is added, remarkably improved dispersion of the powder was obtained and it took short time to grind. The true volume is defined by a ratio of the weight of the powder to the specific gravity of the material of the powder in solid form. Further, contamination of the objective powder due to worn-out grinding media was remarkably reduced.

EXAMPLE 8

An agitating mill similar to the one shown in FIG. 3 was used in this Example 8. The following is a list of representative dimensions of the agitating mill of this Example 8.

TABLE 8

| | Representative dimensions of the agitating mill |
|---|---|
| (1) The inner diameter of the milling vessel 1 | 60 mm |
| (2) The length of the milling vessel 1 | 17 mm |
| (3) The length of the agitator 302a | 15 mm |
| (4) The length of the agitator 302b | 15 mm |
| (5) The outside diameter of the agitator 302a | 50 mm |
| (6) The outside diameter of the agitator 302b | 56 mm |

The milling vessel 1, the partition 315 and the agitators 302*a* and 302*b* were made of zirconia. Two parts of the outside wall of the milling vessel 1 are water cooled respectively, in a manner that water introduced from respective inlet ports of water 321*a* and 21 absorbs heat released from the two parts of outside walls of the milling vessel 1 and is discharged from respective outlet ports of water 322*a* and 22*b*.

The first grinding compartment 309 was charged with powder of zirconia having an average particle diameter of 0.6 mm as the first grinding media. The second grinding compartment 312 was charged with powder of zirconia having an average particle diameter of 0.1 mm as the second grinding media.

In this Example 8, the agitating mill was used under a condition similar to that of the Example 1. Since the peripheral speed of the agitator 302*b* was 100 m/s, the peripheral speed of the agitator 302*a* was 89.3 m/s.

It took 1.5 minutes to obtain the objective powder having an average particle diameter of 0.1 μm. And, the amount of the worn-out grinding media included in the powder was 0.042 weight %. In comparison with the results obtained in the foregoing working sample No. 11 shown in Table 5, the period of grinding in this example became shorter to about 0.65 times that of the working sample No. 11, and the amount of the worn-out grinding media was reduced to one sixth of the worn-out grinding media of the working sample No. 11. Further, in comparison with the results obtained in the foregoing working sample No. 13 shown in Table 5, similar results as to the period of grinding and the amount of the worn-out grinding media were obtained. In the working sample 13, the powder which is preliminarily ground by the ball mill was used in the slurry, but in this Example 8, the powder without preliminary grinding was used in the slurry. Thus in this Example 8, the technical advantage similar to that of the working sample 13 was obtained without the hitherto used time-cost-taking preliminary grinding. The reason is based on the following feature of the agitating mill of this Example 8:

(1) Two grinding compartments are charged with respective grinding media having different average particle diameter, and (2) the value of $D^3 \times V^2$ is kept under 200 in at least one grinding compartment.

When compared with the working sample No. 13 which took a time to grind the powder preliminarily by using the ball mill, the grinding in this Example 8 was carried out in a very short time.

In comparison with the results obtained in the foregoing working sample No. 15 in Table 5, the period of grinding became shorter to one twenty-fourth times that of the working sample No. 15 and the amount of the worn-out grinding media was reduced by times that of the same.

In the above-mentioned Examples 1, 2, 3, 4, 5, 6, 7 and 8, a mixture of 6 kinds of powders of ceramic was used as a material to be ground, when other powders of ceramic was used as the material to be ground, similar results were obtained in our experiments. Further, it was confirmed that obtained results did not depend on the kind of dispersing media.

Though spherical particles of the grinding media were used, in the above-mentioned Example 1, 2, 3, 4, 5, 6, 7 and 8, particles of other shape of particles e.g. an ellipsoidal body of revolution may be included, as far as the sharps are substantially spherical and similar results were obtainable.

Although the present invention has been described in terms of the presently preferred embodiments, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An agitating mill comprising:

a milling vessel having an internal side wall, an agitator having an external side wall, said agitator being inserted in said milling vessel coaxially whereby a gap is formed between said internal side wall and said external side wall defining a grinding compartment for grinding particles of material, driving means connected to said agitator for rotating said agitator, and grinding media including grinding particles, said grinding particles having an average diameter (D(mm)) which is greater than 20 times as large as an average diameter of said particles of material and less than 0.6 mm, said grinding media being charged in said grinding compartment, said driving means adapted to rotate the agitator at such a peripheral speed (V(m/s)) having a relation with said average diameter (D(mm)) and said peripheral speed (V(m/s)) being selected to satisfy the following inequality:

$$D^3 \times V^2 \leqq 200.$$

2. An agitating mill in accordance with claim 1, wherein said gap is in a range between at least two times as large as said average diameter (D(mm)) and 5 mm.

3. An agitating mill in accordance with claim 2, wherein at least one side wall which is selected from said internal side wall and said external side wall has an uneven surface.

4. An agitating mill in accordance with claim 1, 2 or 3, wherein at least two grinding compartments are disposed in said milling vessel and at least two grinding media having average diameter particles different from each other are provided, said at least two grinding media are charged in said at least two grinding compartments, respectively.

5. A method for milling by using an agitating mill having a milling vessel, an agitator disposed in said milling vessel to effect a gap between an internal side wall of said milling vessel and an external side wall of said agitator to form a grinding compartment for grinding particles of material, and driving means connected to said agitator for rotating it, said method comprising the steps of:

charging grinding media in said grinding compartment, said grinding media including grinding particles having an average diameter which is greater than 20 times as large as an average diameter of said particles of material and less than 0.6 mm, charging a slurry into said grinding compartment, said slurry including material powder to be ground, rotating said agitator at a peripheral speed in the range of no less than 30 m/s, and discharging ground slurry, said agitator being rotated at such a peripheral speed (V(m/s)) having a relation with said average diameter (D(mm)) and said peripheral speed (V(m/s)) being selected to satisfy the following inequality:

$$D^3 \times V^2 \leqq 200.$$

6. A method for milling in accordance with claim 5 further comprising:

a step for forming said slurry including the particles of material to be ground, a dispersing media and a dispersing agent in a manner that a volume of said dispersing media is no more than 4 times the volume of said powder to be ground.

7. A method for milling in accordance with claim 6, wherein said slurry has a specific gravity of more than 0.5 times as that of said grinding media.

8. A method for milling in accordance with claim 6, wherein said grinding media particles have an average diameter in the range of from 20 to 2000 times the average diameter of particles of material to be ground, before grinding.

* * * * *